US005537908A

United States Patent [19]

Rabe et al.

[11] Patent Number: 5,537,908

[45] Date of Patent: Jul. 23, 1996

[54] ACOUSTIC RESPONSE OF COMPONENTS OF MUSICAL INSTRUMENTS

[76] Inventors: Steven W. Rabe, 3740 Beechglen Dr., Glendale, Calif. 91214; Michael J. Tobias, 780 Zena Highwoods Rd., Kingston, N.Y. 12401

[21] Appl. No.: 193,370

[22] Filed: Feb. 8, 1994

[51] Int. Cl.[6] ..... G10G 7/02

[52] U.S. Cl. ..... 84/454; 84/453; 84/312 R

[58] Field of Search ..... 84/312 R, 454, 84/453, 723, 743, 294, 267, 291, 293

[56] References Cited

U.S. PATENT DOCUMENTS

| | | | |
|---|---|---|---|
| 2,911,872 | 11/1959 | Carl | 84/453 |
| 4,464,967 | 8/1984 | Trimborn | 84/723 |
| 4,697,491 | 10/1987 | Maloney | 84/723 |
| 5,031,501 | 7/1991 | Ashworth | 84/723 |

FOREIGN PATENT DOCUMENTS 850160 12/1939 France .

OTHER PUBLICATIONS

"Let a Robot Play Your String Musical Instrument For You" *Reliance Research & Manufacturing Co.*

"The Secret of the Stradivarius Violins Revealed" *LDS Update;* Issue 4; Spring 1989; pp. 1–2.

"How a Shaker Shakes" *Test & Measurement World;* Aug. 1993; pp. 41–42.

*Primary Examiner*—Cassandra C. Spyrou
*Attorney, Agent, or Firm*—Robbins, Berliner & Carson

[57] ABSTRACT

A method for improving the sound producing ability of musical instruments by securing at least some components of the instrument to a supporting surface and then vibrating the surface at various frequencies across a broad bandwidth for an optimal time. This method may be applied to partially assembled instruments during the manufacturing process, to completed instruments with strings and/or hardware removed, and to fully assembled new and old instruments.

20 Claims, 4 Drawing Sheets

ACOUSTIC RESPONSE OF COMPONENTS OF MUSICAL INSTRUMENTS

FIELD OF THE INVENTION

The invention relates generally to the construction of musical instruments, and more particularly to a manufacturing process for providing a "seasoned" instrument (or component thereof) expeditiously and at relatively low cost.

BACKGROUND ART

For many years musicians have appreciated the sound producing ability of older wooden instruments such as guitars and violins. It is known by those skilled in the art that new wooden musical instruments do not sound as good as properly maintained and regularly played instruments that are several years old. Further, a good sounding wooden musical instrument that has not been regularly played experiences a noticeable degradation in sound quality over a period of several years.

There have been many attempts to artificially age an instrument to improve its sound producing quality. One method reputed to be in commercial use in Germany involves placing an electric guitar in front of loudspeakers in an enclosed room and subjecting the instrument to loud music emitted from said loudspeakers.

Ashworth U.S. Pat. No. 5,031,501 discloses attaching a transducer to the sound board of a stringed instrument such as a guitar or violin and applies an amplified musical signal to the transducer to thereby simulate what the sound board experiences as the instrument is being played. Ashworth's invention provides automatic means to simulate playing the instrument, thus allowing the instrument to be aged without the expenditure of any time or effort by a real musician. However, it will still take a prolonged period of time to age a new instrument using Ashworth's method because his invention merely facilitates "playing" the instrument of an increased amount of time, and is not suitable for subjecting an instrument to the effects of many years of use.

Additionally, some instruments inherently have "dead" and/or "hot" spots. With these instruments the sound producing ability of the instrument is uneven over its range. There are no known methods for curing these sound producing anomalies without physically repairing the instrument or dramatically altering some of the parts of the instrument.

Electrodynamic vibration shakers are typically used in the aerospace industry to verify whether a piece of hardware meets a particular military or commercial specification for resistance to vibration. The simplest shakers are controlled by a single frequency sinusoidal signal, which results in the shaker, and any piece of equipment supported by the shaker, to be subjected to a sinusoidal motion. More recently, shakers have been developed which are controlled by a broad spectrum signal, which produces vibration simultaneously and randomly over a broad spectrum of frequencies. The vibration produced by such broad spectrum shakers is typically measured in units of acceleration (g rms), and may be represented in graphic form as the power spectrum density ($g^2$/Hz). Although sophisticated digitally controlled vibration testing and related measuring techniques have been used to analyze the acoustic response of a musical instrument such as a Stradivarius violin, such tests have used relatively low amplitude vibrations applied for a relatively short period of time and there have been no reports of any noticeable change in sound quality as a result of such testing.

From the above, it may be appreciated that the prior art lacks any suggestion of a relatively simple and quick method for making a new instrument produce the sound quality heretofore associated only with older instruments, for restoring the sound producing quality of an instrument that has been unplayed for many years and for correcting anomalies in the sound production of an instrument having "dead" or "hot" spots in its useful range.

DISCLOSURE OF INVENTION

It is thus an overall objective of the present invention to improve the sound producing ability of musical instruments. The invention is particularly applicable to wooden instruments (such as a guitar) or instruments having wooden components (such as a drum or piano), but may also find application with other types of musical instruments and components of musical instruments (such as the pickup coil of an electric guitar). Preferably, the method is implemented by taking the wooden portions of a wooden instrument after they are cut and assembled but before any strings and/or hardware is added, securing the wooden subassembly to a vibrating fixture and then vibrating the fixture. Alternately, a fully assembled instrument, with or without its strings and other hardware, may be secured to the vibrating fixture. It has been proven experimentally that vibrating the wooden components of certain types of musical instruments for less than 30 minutes at randomly generated frequencies within a broad frequency band ages the wood the equivalent of 10 to 20 years and duplicates the sound producing ability of a well-seasoned instrument.

BRIEF DESCRIPTION OF THE DRAWINGS

The foregoing and other features and advantages of this invention will become further apparent from the detailed description and accompanying figures that follow. In the figures and description, numerals indicate the various features of the invention, like numerals referring to like features throughout both the drawings and the description, in which.

DETAILED DESCRIPTION OF THE PREFERRED EMBODIMENT

The invention will now be described with particular application to wooden stringed musical instruments. This method has been found to improve the sound producing ability of instruments that are new, as well as of old instruments that have not been played for a long period of time. Additionally, this method may be used to improve the sound producing ability of an instrument with "dead" or "hot" spots.

Figure 1A:
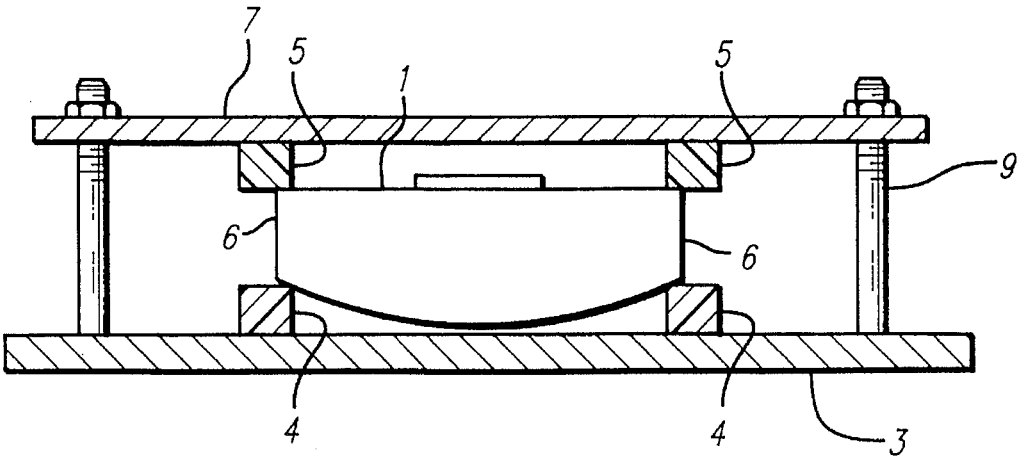
FIG. 1A is a sectional view of an acoustic guitar secured to a vibrating table.

When used to improve the sound producing ability of new guitars, the guitar is preferably assembled to the point where only the strings and hardware must be attached. Referring now to FIG. 1A, a hollow acoustic guitar 1 is placed on a supporting surface provided by the flat upper surface of vibrating table 3. The back of guitar 1 is placed adjacent the upper surface of table 3, with supporting pieces 4 used in the vicinity its sidewalls to support guitar 1 above the table's upper surface when the guitar is secured to table 3. By this means, no pressure need be applied directly to the slightly bowed and relatively fragile soundboard forming the back of the guitar 1. Holding pieces 5 are placed on the front of guitar 1 on either side of its "rose" (sound hole) in alignment with the side walls and above the supporting pieces 4. At least one cross beam 7 is placed over holding pieces 5 and supporting pieces 4. Threaded rods 9 are placed through cross beam 7 and secured to table 3 by screwing or other securing means. Securing rods 9 to table 3 causes tension forces to be exerted between holding pieces 5 and table 3 via supporting pieces 4, which secure the body of guitar 1 firmly to the vibrating table 3. Note that, at least in the presently preferred embodiment now being described, the neck of guitar 1 is not directly secured to table 3.

Figure 1B:
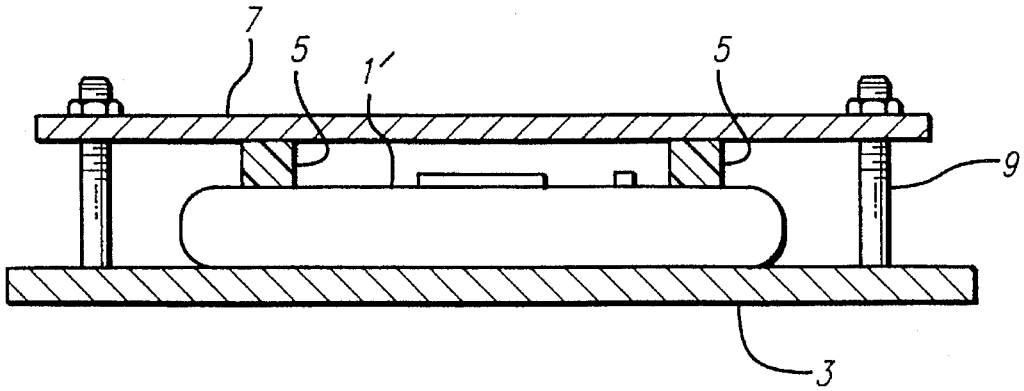
FIG. 1B is a sectional view of an electric guitar secured to a vibrating table.
Figure 2:
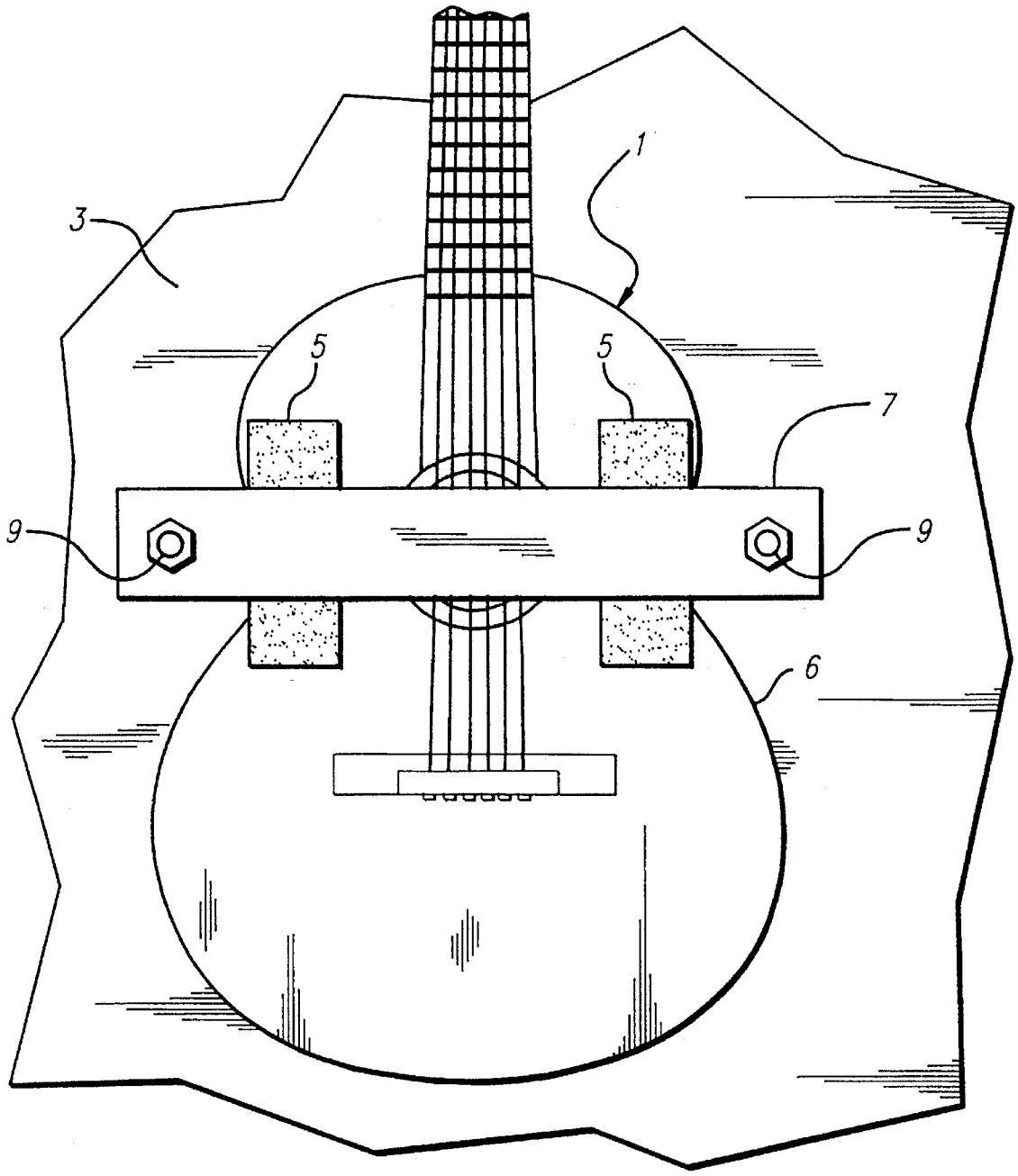
FIG. 2 is a top planar view of a guitar secured to a vibrating table.

Referring now to FIG. 1B, which shows an alternate embodiment adapted for use with a solid-bodied electric guitar 1', it may be seen that since the body is relatively flat and has a relative flat back, no supporting pieces 4 are required, but only a thin pad (not shown) intended to keep the guitar 1 from being scratched.

After an instrument has been secured to the table 3, the table is vibrated for a period of time sufficient to result in a noticeable change in sound quality. In a presently preferred embodiment the preferred time is in the range from about five to about sixty minutes, and the optimal time is somewhat less than about 30 minutes.

Figure 4:
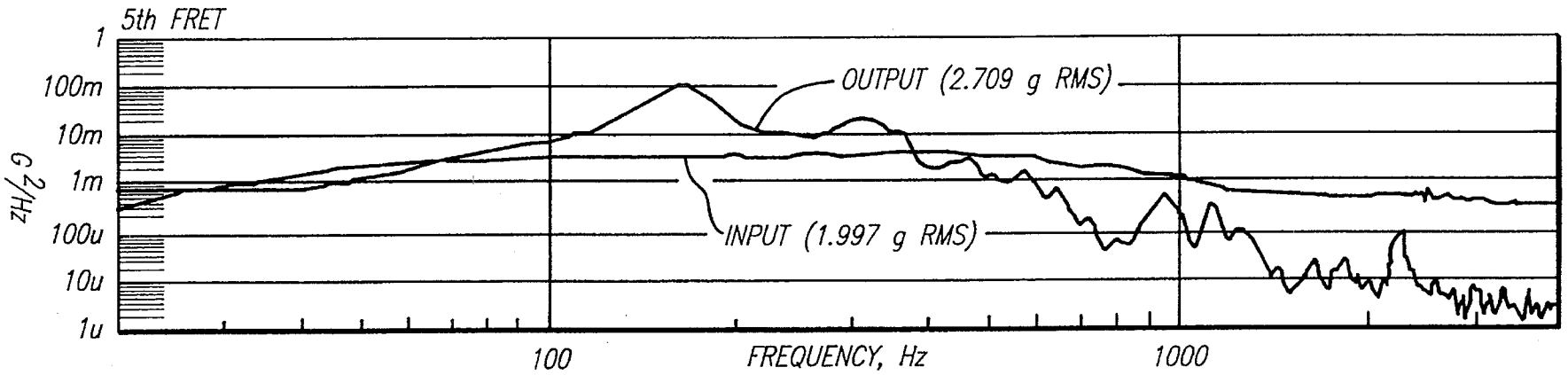
FIG. 4 is a graph of the sound resonating properties at the 5th fret of a new guitar toward the beginning of being subjected to the method of the present invention.
Figure 5:
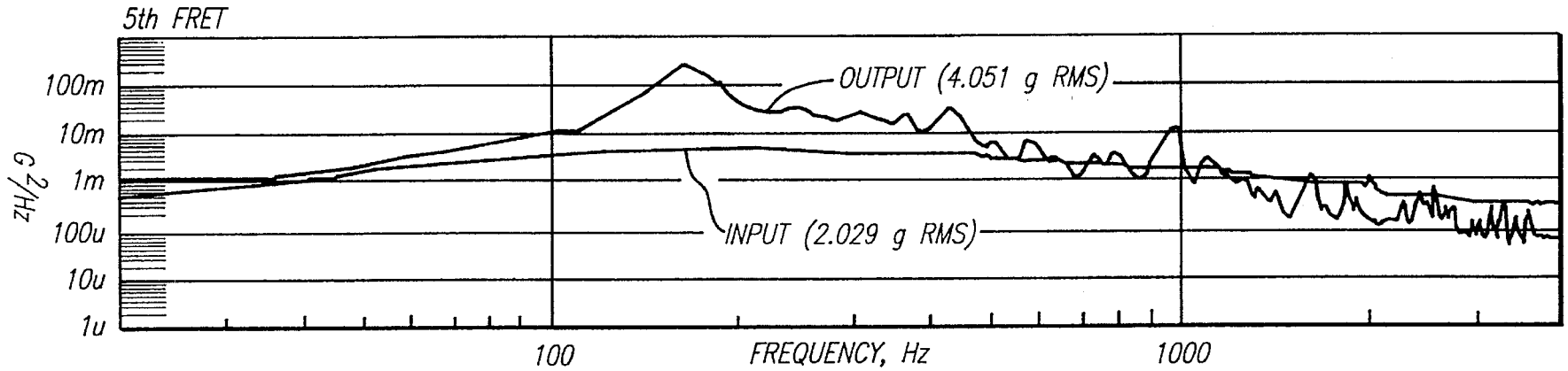
FIG. 5 is a graph of the sound resonating properties at the 5th fret of a new guitar toward the end of being subjected to the method of the present invention.

In a currently preferred embodiment, the vibrating table is vibrated along a vertical axis in a broadband spectrum from about 20 to about 2,000 cycles per second for instruments having a relatively low frequency spectrum (such as drums, bass guitars and bass violins, and from about 20 to about 4,000 cycles per second for other instruments (guitars, violins, etc.). Reference should now be made to FIGS. 4 and 5, which graphically depict the spectral density of the input and output acoustic power measured in $g^2$/Hz (vertical axis) as a function of frequency measured in Hz (horizontal axis). In that embodiment, the applied vibrational energy varies randomly and preferably with a maximum "power spectrum density" of about 0.007 $g^2$/Hz across the entire frequency spectrum of interest with a power spectrum density profile in accordance with MIL-STD P9294, Random Vibration Test Specification (also referred to as NAVMAT), to produce an average (rms) acceleration of about 2 g, as illustrated by the "input" line in FIGS. 4 and 5, using a shaking system such as that manufactured by Ling Dynamic Systems of Yalesville, Conn. Although tests to date have been limited to the particular power spectrum density described above and shown in the drawings, somewhat higher or lower power densities and average accelerations may be desirable for other applications and the power spectrum density may be further increased or decreased at particular frequencies or ranges of frequencies. Moreover, in other implementations, those particular frequencies may be determined in a closed loop control system such that they correspond to frequencies corresponding to particular frequency anomalies of a particular instrument. The power level (which is a function of the amplitude or displacement of the vibrations) is preferably selected to be as strong as possible without any risk of damage to the instrument, thereby producing a maximum result in a minimum time. Although the described embodiment vibrates the instrument only in a vertical axis extending from the front to the rear of the guitar when it is laid flat on its back, shakers are known which can be vibrated along other axes, or more than one axis simultaneously.

Essentially the same method can be used for a previously manufactured instrument. The fully assembled guitar may be attached to table 3 as described previously, or the strings and hardware may be removed before placing the wooden portion of the guitar onto the table 3. It has been found experimentally that the method of the invention is equally effective with finished instruments and with partially assembled instruments; removing the strings, or at least loosening any tension on the strings, minimizes the stress on the joint between the unsupported neck to the body (or any other vulnerable parts of the instrument) and is expected to reduce the possibility of the instrument being damaged during the aging process, particularly if extremely high levels of vibration are employed.

It should be understood that, with minor variations, the same method can be used for all stringed instruments, as well as for other instruments made entirely or partly from wooden components such as woodwinds, drums, pianos, and the like, as well as for certain non-wooden components such as the pickup of an electric guitar which experience a significant improvement in sound quality after a prolonged period of use (a new pickup coil or a newly waxed old coil lacks desirable sensitivity to microphonics). For example, the single vibrating table 3 may be replaced with a plurality of modal shakers, which permits the required vibration to be applied to a component (such as the soundboard of a grand piano) which is larger than a single vibrating table 3, and which also permits the vibration to be applied to different portions of the component being aged with different frequencies, amplitudes, and/or phases.

Further, the method of the present invention may be used to improve the sound producing ability of wooden drums (such as snare, tom, and bass drums). Wooden drum hoops may be attached in a similar manner to that described above with respect to the hollow acoustic guitar of FIG. 1A either before the drum heads and other hardware are attached during the manufacturing process, or to an already assembled drum after the heads and other hardware are optionally removed.

As noted previously, the present invention may be used to improve the sound producing ability of pianos and harpsichords. In the same manner as with drums and guitars, the wooden portion of the internals of a piano, for example the supporting frame holding the wooden sound board of a small upright piano, may be attached to a sufficiently large shaker table 3 before the strings and hardware are attached. Also, already assembled pianos may also be subjected to this method (possibly using the previously mentioned modal shakers) with the strings and hardware attached or removed.

Moreover, it is believed that the present invention may also be used to improve the sound producing ability of wooden woodwind instruments such as clarinets, oboes, bassoons, and recorders. The attachment is similar to that already described above with regard to guitars.

Figure 3:
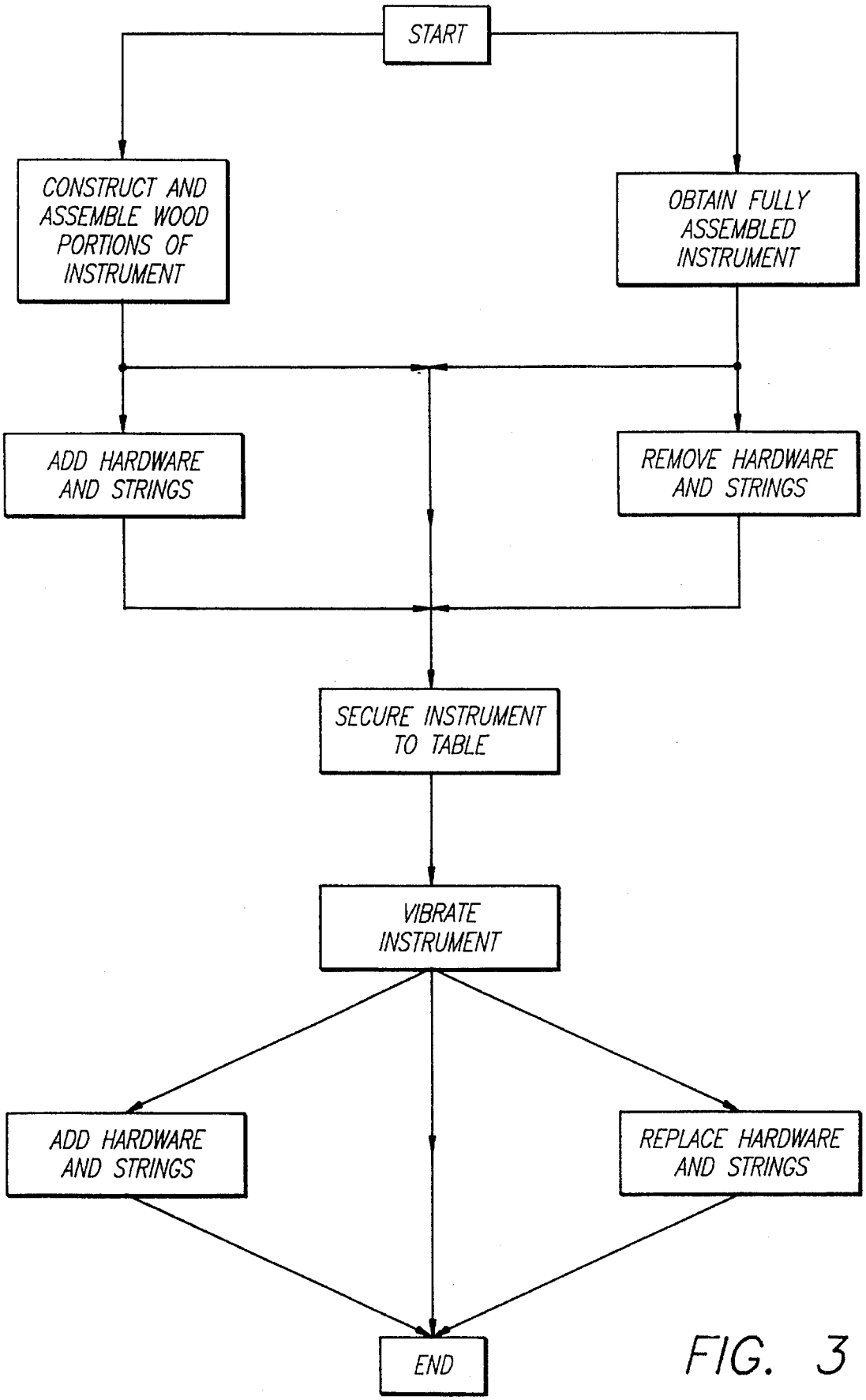
FIG. 3 is a flow chart depicting alternate embodiments of the method of the present invention.

The method of the present invention may also be applied to guitars and other instruments with their strings and hardware attached so long as the vibrating applied to the instrument is less than that which will damage the instrument. An assembled instrument is instantly playable after being subjected to the method of the present invention and, if previously having dull tonal characteristics or plagued with "dead" spots or "hot" spots, will show an immediate improvement. Obviously, if the strings and/or hardware were removed or had not yet been attached, the strings and/or hardware must be attached before the improved sound producing ability of the instrument can be experienced in actual use. A flow chart depicting alternate paths each corresponding to a different embodiment of the method of the present invention is shown in FIG. 3.

The improvement in the sound producing ability of wooden musical instruments subjected to this method is great. Experienced musicians have attested to hearing the improvement in sound producing ability after application of the method of the present invention. At least certain aspects of the improvement can be objectively measured by attaching an accelerometer and measuring the resonances of the wooden portions of the instrument toward the beginning and end of application of the method of the present invention. Referring to FIG. 4, the acoustic properties of an acoustic Martin guitar toward the start of applying the method have been measured at its fifth fret (the "output" line). It is clearly seen that the resonance of the guitar at that same location toward the end of application of the method of the present invention, as shown in FIG. 5, have been changed across the entire audible frequency range, particularly at higher frequencies.

Those skilled in this art should have no difficulties making changes and modifications in the method of the invention in order to meet their specific requirements or conditions, without departing from the scope and spirit of the invention as set forth in the following claims.

What is claimed is:

1. A method for improving an acoustic response of a component of a musical instrument comprising the steps of:

securing the component to a supporting surface;

vibrating the supporting surface until an acoustic resonance spectrum of said component has been changed; and removing the component from the supporting surface.

2. The method of claim 1 wherein said component comprises a pick up coil.

3. The method of claim 1 wherein said component comprises at least a wooden portion.

4. The method of claim 3 wherein said wooden portion comprises a wooden soundboard of a piano.

5. The method of claim 3 wherein said wooden portion comprises a wooden drum hoop of a drum.

6. The method of claim 3 wherein said wooden portion comprises a body and a neck of a stringed instrument.

7. The method of claim 3 wherein the component is a stringed instrument to which strings and associated hardware have not yet been attached, and said method further comprises the step of attaching the strings and associated hardware after said vibrating step has been completed.

8. The method of claim 3 wherein the component is a fully assembled wooden musical instrument selected from a group consisting of stringed instruments, percussion instruments, and woodwinds.

9. The method of claim 8 wherein the instrument is a stringed instrument comprising strings and other hardware, and the securing step is preceded by the step of removing the strings and other hardware.

10. The method of claim 3 wherein the instrument is a stringed instrument selected from a group consisting of acoustic guitars and electric guitars.

11. The method of claim 10 wherein the instrument is a hollow acoustic guitar having a sidewall and said securing step further comprises the step of providing a support in the vicinity of the sidewall.

12. The method of claim 10 wherein the instrument is an electric guitar having a solid body and said securing step further comprises the step of supporting said solid body on said supporting surface.

13. The method of claim 1 wherein the securing step further comprises the steps of:

placing a body portion of a wooden musical instrument on the supporting surface;

placing holding pieces above the instrument;

placing a cross beam over the holding pieces; and exerting a tension force between the cross beam and the table.

14. The method of claim 13 wherein the instrument has a hollow body; and the step of securing a wooden instrument further comprises the step of using supporting pieces to support the wooden instrument above the supporting surface in the vicinity of a sidewall of the hollow body.

15. The method of claim 1 wherein the step of vibrating the supporting surface comprises vibrating the supporting surface at a plurality of frequencies between about 20 and about 4,000 cycles per second for about from 5 minutes to 60 minutes.

16. The method of claim 1 wherein the step of vibrating the supporting surface is terminated after no more than about 30 minutes.

17. The method of claim 1 wherein said supporting surface is vibrated for a period of time within a range from about five to about sixty minutes.

18. A method for improving the sound producing ability of wooden musical instruments comprising the steps of:

securing at least one wooden portion of an instrument to a supporting surface; and vibrating the supporting surface for a maximum of about 30 minutes with a random spectrum of frequencies spanning the range from less than about 200 to at least about 2,000 cycles per second.

19. The method of claim 18, wherein said vibrating is performed in accordance with a predetermined power spectrum density profile and an average acceleration limited only by a predetermined power level which could result in damage to the wooden musical instrument.

20. A method for manufacturing a guitar comprising the steps of:

forming individual wooden components to be used for a body and a neck of a guitar;

attaching the neck to the body, resulting in a partially assembled guitar;

securing the partially assembled guitar to a supporting surface;

vibrating the supporting surface for about 30 minutes at a plurality of frequencies over a frequency range of about 20 to about 4,000 vibrational cycles per second with a sufficiently high power density spectrum to cause a permanent change in a resonance spectrum of the partially assembled guitar;

removing the guitar from the supporting surface at the conclusion of said vibrating step; and attaching hardware and strings to the partially assembled guitar.

* * * * *